US009322124B1

(12) United States Patent
Al-Hasan

(10) Patent No.: US 9,322,124 B1
(45) Date of Patent: Apr. 26, 2016

(54) PORTABLE DRIER FOR PERSONAL ARTICLES

(71) Applicant: Khaled J. H. Al-Hasan, Zaharah (KW)

(72) Inventor: Khaled J. H. Al-Hasan, Zaharah (KW)

( * ) Notice: Subject to any disclaimer, the term of this patent is extended or adjusted under 35 U.S.C. 154(b) by 0 days.

(21) Appl. No.: 14/789,971

(22) Filed: Jul. 1, 2015

(51) Int. Cl.
*F26B 9/00* (2006.01)
*D06F 58/10* (2006.01)

(52) U.S. Cl.
CPC ..... *D06F 58/10* (2013.01)

(58) Field of Classification Search
CPC ..... A47L 19/00; A47L 23/205; D06F 58/14; D06F 58/10; D06F 73/02; D06F 87/00; D06F 73/00; D06F 58/203; D06B 5/24; D06B 5/00; A47G 25/12
USPC ..... 34/622
See application file for complete search history.

(56) References Cited

U.S. PATENT DOCUMENTS 1,597,565 A * 8/1926 Backus ..... A47G 25/12 211/135
3,737,942 A 6/1973 Casey
4,625,432 A 12/1986 Baltes
4,682,424 A 7/1987 Irving
5,369,892 A * 12/1994 Dhaemers ..... D06F 58/10 34/224
5,412,928 A 5/1995 Reithel
5,555,640 A 9/1996 Ou
5,666,743 A * 9/1997 Dawson ..... F26B 9/003 34/202
5,713,137 A * 2/1998 Fujita ..... D06F 58/14 34/106
5,870,836 A 2/1999 Grimes
7,562,543 B2 * 7/2009 Kendall ..... A47B 46/00 312/228.1
D617,063 S 6/2010 Bischoff et al.
8,555,519 B2 * 10/2013 McFarland ..... F26B 9/003 190/124
2005/0050756 A1 3/2005 Casella
2010/0058608 A1 * 3/2010 Moon ..... D06F 58/10 34/282

FOREIGN PATENT DOCUMENTS

CN 203524153 9/2014

* cited by examiner

*Primary Examiner* — Kenneth Rinehart
*Assistant Examiner* — Bao D Nguyen
(74) *Attorney, Agent, or Firm* — Richard C. Litman

(57) ABSTRACT

The portable drier for personal articles includes a wheeled cabinet having vertically oriented front and rear compartments. The front compartment is open at the front and provides for the hanging of damp or wet clothing and the like therein. A lower shelf extends across the front of the front compartment, for drying other articles. The shelf includes a series of receptacles for holding umbrellas and the like. The rear compartment includes a sinusoidal steam pipe array, with a fan or blower in the lower portion of the cabinet drawing air through the open front and blowing the air up past the steam pipes and through a louvered panel to dry articles in the front compartment. The drier may include additional features, such as an ultraviolet light for bactericidal and fungicidal cleansing, an air circulation filter, an ironing board and steam iron, and an electronic scent dispenser.

1 Claim, 4 Drawing Sheets

PORTABLE DRIER FOR PERSONAL ARTICLES

BACKGROUND OF THE INVENTION

1. Field of the Invention

The present invention relates generally to devices for the treatment of clothing and similar articles, and particularly to a portable cabinet for drying and treating personal articles such as clothing, blankets, umbrellas, and the like.

2. Description of the Related Art

Dealing with wet or damp clothing, footwear, umbrellas, and various other articles is a frequent problem in most areas of the world. While many of these articles can be handled in a similar manner, others require different care. As an example, a raincoat or other outerwear may generally just be hung up on an appropriate hanger and allowed to dry without much additional care or concern, but other articles such as sweaters and the like must be handled differently in order to preclude stretching or shrinking. Moreover, applying some form of heat generally aids in the evaporation of moisture from various articles, but the heat must be regulated or moderated to prevent damage to many articles.

The conventional automatic drier used for drying laundry is unsuitable for drying many of the above articles, as such driers generally apply too much heat even on their lowest settings and the tumbling action is unsuitable for use in drying many articles such as footwear, umbrellas, etc. Moreover, while such automatic clothes driers are generally quite good at removing any traces of mold or other organisms that may have taken residence upon damp articles, they do so by means of the relatively high heat that is developed in such driers, rather than by more gentle means that is better suited to many articles.

Accordingly, a number of devices and machines for drying various articles have been developed in the past. An example of such is found in Chinese Patent Publication No. 203524153 published on Apr. 9, 2014 to Huazhong Normal University. This publication describes (according to the drawings and English abstract) a portable roll-around cabinet for drying umbrellas. The cabinet includes a matrix of horizontal compartments, with each compartment adapted for holding one folded umbrella therein. Hair driers blow heated air into the compartments.

Thus, a portable drier for personal articles solving the aforementioned problems is desired.

SUMMARY OF THE INVENTION

The portable drier for personal articles provides for the drying and sanitizing of various articles, e.g., rain gear, clothing, umbrellas, footwear, blankets, etc. The device generally comprises a cabinet having an open front for convenient access to the article drying compartment or volume. A hanger rod extends across the upper interior of the front compartment, and an article drying shelf extends across the lower front of the front compartment. The shelf includes a series of receptacles for umbrellas or the like.

The rear portion or compartment of the cabinet includes a sinusoidal array of steam pipes for providing gentle heat to the forwardly disposed article drying compartment, with a louvered panel separating the steam heating compartment or volume and the article drying compartment or volume. A heating unit is installed in the lower portion of the device, to heat water for the steam system. Air is circulated by a rotary blower or fan disposed in the lower portion of the device. Outside air is drawn into the cabinet by the blower or fan, with the air being directed up the back of the cabinet and through a filter before passing around the steam heating pipes.

The device may include additional features, such as an ultraviolet light disposed above the clothes hanger rod to provide additional bactericidal and fungicidal effect and an electronic scent dispensing device to add a pleasant fragrance to articles treated in the cabinet. A fold-out ironing board may be provided at one panel of the device, with a steam iron receiving steam from the steam heating unit in the device.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The portable drier for personal articles serves as a versatile device for the drying of damp or wet articles of clothing, footwear, umbrellas, quilts and blankets, sleeping bags, and other similar articles. The portable drier is easily moved to any particular location where it may be needed. The portable drier is particularly useful for commercial establishments such as hotels and the like, but will find great utility in many households as well.

Figure 1:
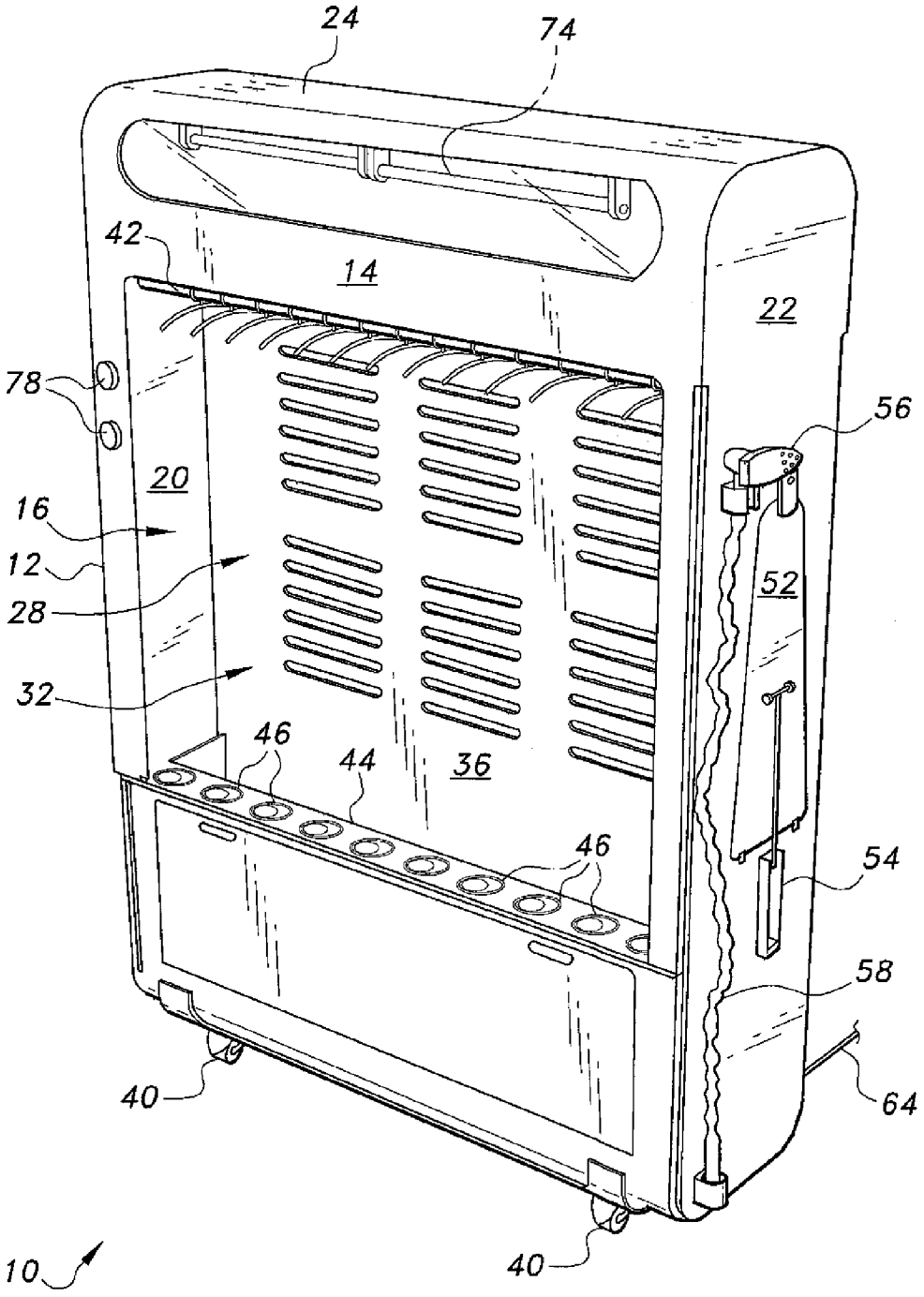
FIG. 1 is a front perspective view of a portable drier for personal articles according to the present invention, illustrating its general features.
Figure 3:
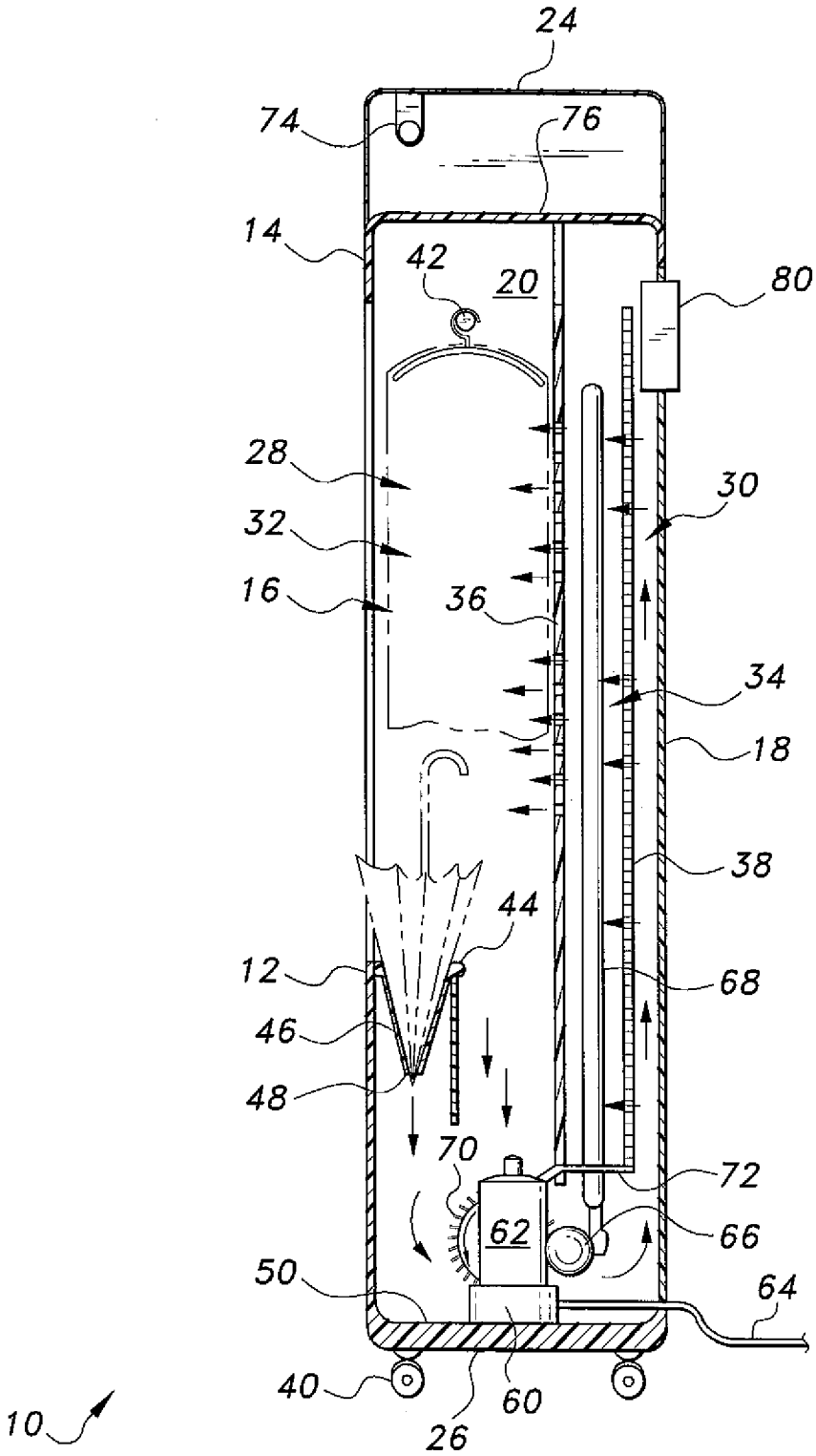
FIG. 3 is a side elevation view in section of the portable drier for personal articles according to the present invention, illustrating further internal structure.

FIG. 1 of the drawings provides a front perspective view of the portable drier for personal articles 10, and illustrates many of its critical features. The portable drier 10 essentially comprises a cabinet 12 having a front panel 14 with a permanent opening 16 therein, i.e., there are no doors or other means for closing access to the opening 16 of the front panel 14. The cabinet 12 further includes a rear panel 18 (FIGS. 3 and 4), opposing first and second side panels 20 and 22, a top panel 24, and a bottom panel 26 (FIG. 3). The various panels 18 through 26 are all normally closed when the portable drier 10 is in operation, but various ones of these panels may have doors or other means for accessing the interior of the cabinet 12 as needed.

Figure 2:
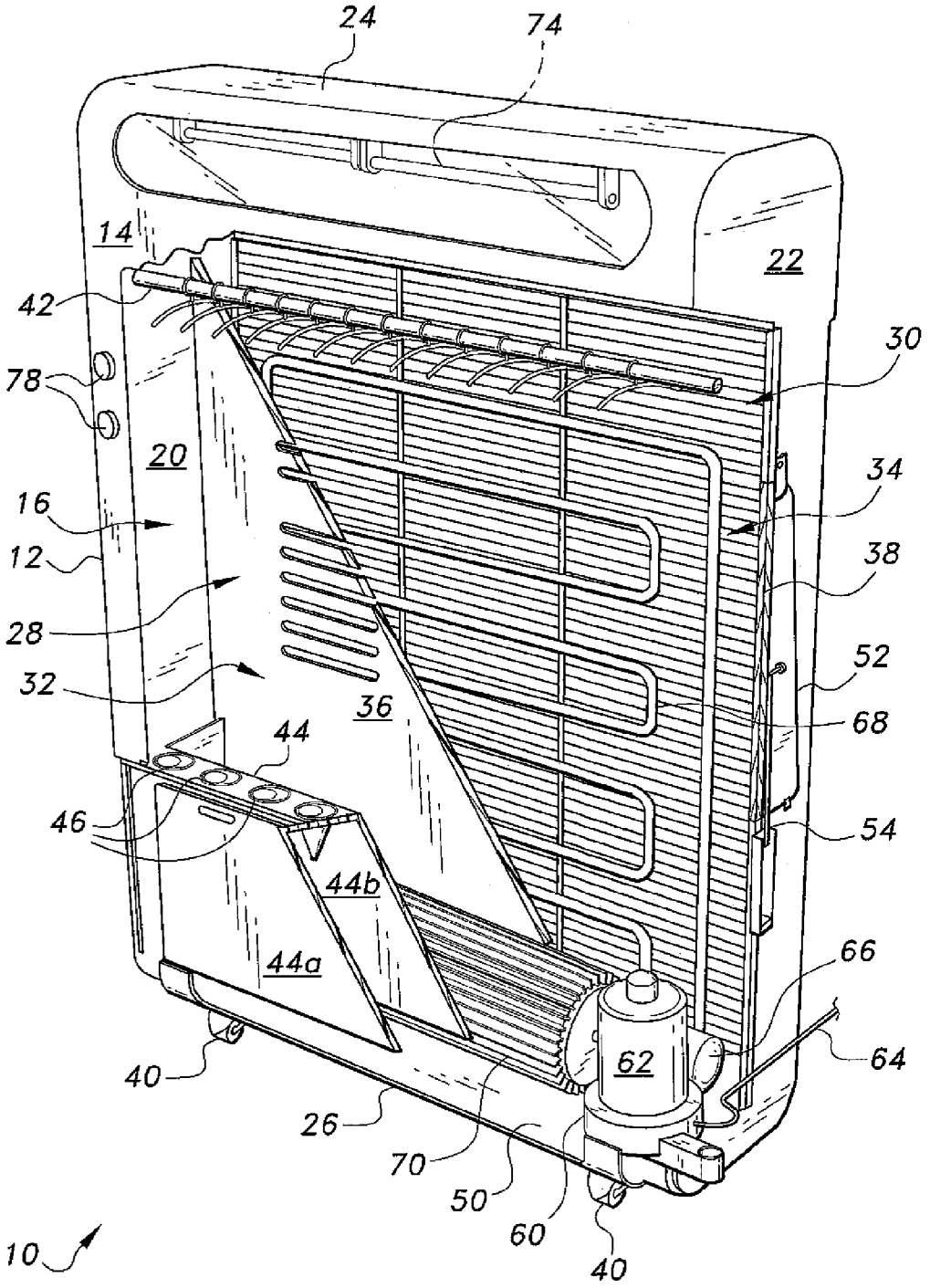
FIG. 2 is a front perspective view in partial section of the portable drier for personal articles according to the present invention, illustrating the internal structure thereof.

FIGS. 2 and 3 provide views of the interior of the portable drier 10 and its cabinet 12. The various panels 18 through 26 define a forward portion or volume 28 and a rearward portion or volume 30 therein. An article drying compartment 32 is disposed within the forward portion 28 of the cabinet 12, with a heater compartment 34 being disposed within the rearward portion 30 of the cabinet 12. A generally vertically oriented louvered panel 36 is disposed between the two compartments 32 and 34, with the louvers allowing passage of air from the heater compartment 34 to the forwardly disposed article drying compartment 32. The heater compartment 34 also contains a generally vertically disposed air filter 38 therein, spaced forwardly of the rear panel 18 and rearwardly from the louvered panel 36, for filtering air that is circulated through the cabinet 12 as described further below. The entire cabinet 12 is supported by a plurality of wheels 40, which may comprise casters or other suitable devices to allow the cabinet 12 to be rolled to any desired location as practicable.

The forwardly disposed article drying compartment 32 includes a transverse article hanger rod 42 that extends between the two side panels 20 and 22. An article drying rack 44 is located in the forward portion 28 of the cabinet 12, immediately below the open front panel 14. The article drying rack 44 preferably includes a plurality of umbrella holders 46 therein, with each of the holders 46 having an inverted conical configuration for holding a loosely folded umbrella. Each of the holders 46 further includes at least one drain passage 48 (FIG. 3). Water dripping or draining from umbrellas stored in the umbrella holders 46, and water dripping or draining from any articles suspended from the hanger rod 42, collects in the bottom panel 26, which serves as a water collection tray 50 (FIGS. 2 and 3). The article drying rack 44 includes two opposing side walls 44*a* and 44*b*, which provide barriers to prevent dripping water from reaching surrounding areas.

Figure 4:
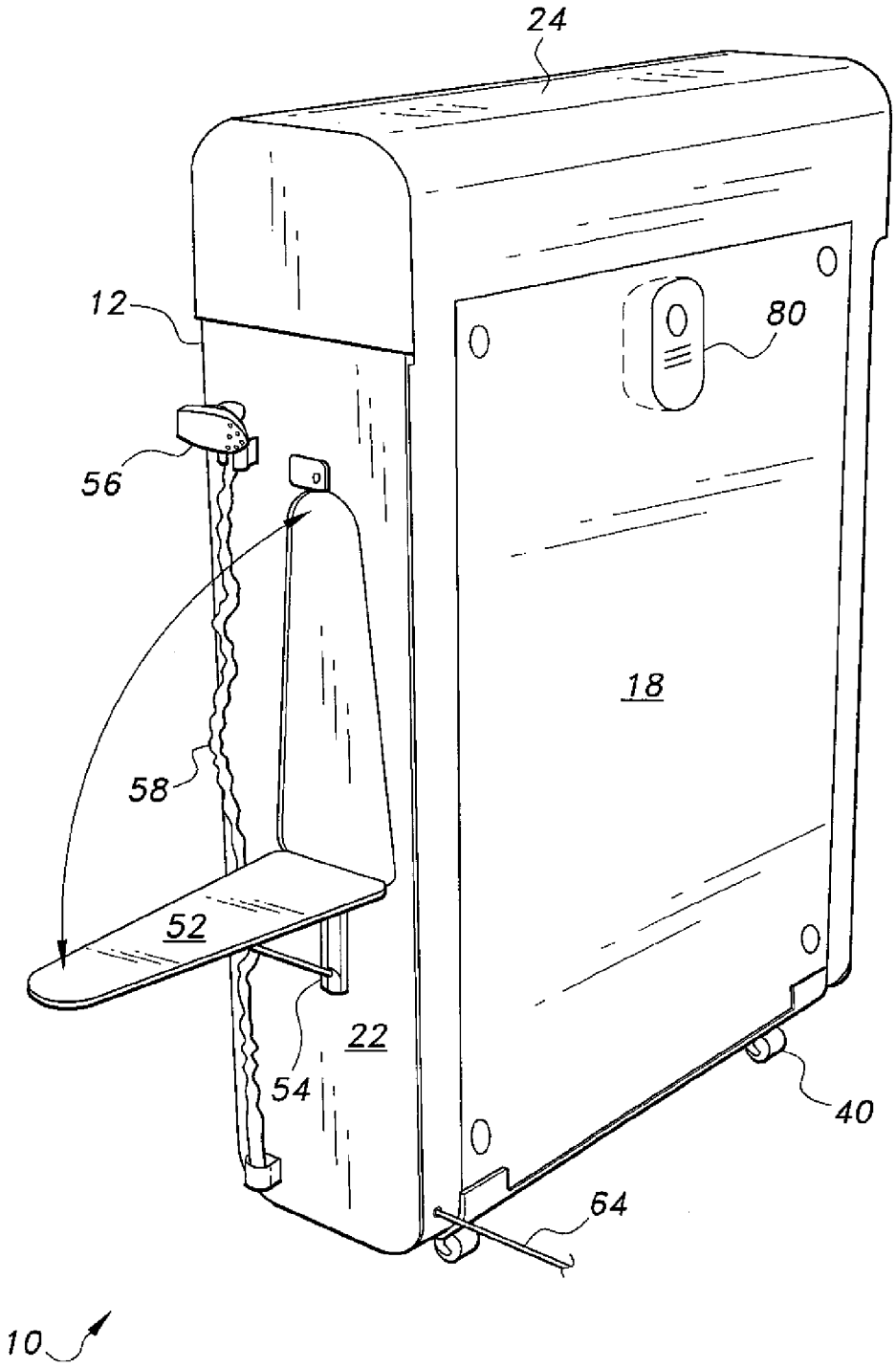
FIG. 4 is a rear perspective view of the portable drier for personal articles according to the present invention, illustrating additional features thereof.

A fold-out ironing board 52 may be provided with the portable drier 10, if so desired. The cabinet 12 is sufficiently wide as to allow an ironing board of conventional width to be installed in or on one of the sides thereof, e.g., the second side 22. The ironing board 52 is supported by a brace or support assembly 54 when in its deployed position, as shown in FIG. 4. An electric steam iron 56 is preferably provided adjacent to the ironing board 52 for use with the ironing board 52.

The iron 56 receives electrical power for heating and also steam for steaming any articles being ironed by an electrical cable and steam hose or line 58 that extends from a steam generator 60 located in the bottom of the cabinet 12, upon the bottom panel 26, as shown in FIGS. 2 and 3. Water for steam production may be provided from a water tank 62 located with the steam generator 60, or may in some cases be drawn from water drainage collected in the water collection tray 50 of the bottom panel 26, with suitable filtration. Electrical power for the steam generator 60 and iron 56, as well as for other electrically powered devices used with the portable drier 10, is provided by a conventional electrical cord 64 plugged in to a conventional electrical outlet or otherwise connected to a suitable source of electrical power.

A pump 66 connected to the steam generator 60 pumps the heated steam through a sinusoidal heating pipe array 68 located within the heater compartment 34. The heating pipe array 68 is oriented generally vertically within the heater compartment 34, between the air filter 38 and the louvered panel 36. An air circulation system or fan 70 comprising a louvered cylindrical fan, i.e., a "squirrel cage" fan, is installed in the lower portion of the cabinet 12 above the bottom panel 26 so as to remain clear of water that may collect in the water collection tray 50. Other fan configurations may be used as desired. The fan 70 is powered by a conventional electric motor (not shown) that receives electrical power from the source to which the electric cord 64 is connected. The fan 70 draws air through the open front 16 of the front panel 14 and blows that air back to the heater compartment 34 in the rear portion or volume 30 of the cabinet 12. An air baffle 72 (FIG. 3) is installed to direct the airflow up between the rear panel 18 and the air filter 38, whereupon the air flows through the filter 38 to be heated by the steam pipe heating array 68. The filtered and heated air then flows through the louvers of the louvered panel 36 to provide gentle heat to any articles that may be placed within the forward article drying cabinet 32. The air may exit the cabinet 12 through the open front 16 thereof, or may be drawn back through the fan 70 for recirculation.

The portable drier for personal articles 10 may include additional features to enhance the treatment of articles placed therein. One such feature may be the provision of an ultraviolet lighting source 74 in the upper portion of the cabinet 12. The ultraviolet lighting source may comprise one or more fluorescent tubes selected to radiate light primarily in the ultraviolet spectrum, or other lighting means as desired. The relatively high energy radiation emitted by such an ultraviolet light source 74 provides a bactericidal and/or fungicidal action, serving to kill off such microbes, fungi, etc. that may inhabit articles placed within the cabinet 12 for drying. The ultraviolet light passes through an ultraviolet translucent or transparent panel 76 disposed in the upper portion of the cabinet 12, between the ultraviolet lighting source 74 and the top of the article drying compartment 32, i.e., above the hanger rod 42. Control of the ultraviolet lighting 74, as well as the steam heater 60 and air circulation fan 70, may be provided by suitable controls 78 disposed upon the front panel 14.

A scent dispenser 80 (FIGS. 3 and 4) may be disposed within the rear panel 18 to emit a pleasant fragrance that is diffused within the air circulating through the heater compartment 34, to be carried through the louvered panel 36 and into any articles that may be placed within the article drying compartment 32 of the forward portion or volume 30 of the cabinet 12. Access to the various internal components of the portable drier 12 may be provided by selectively openable or removable portions of the lower portion of the front panel 14 and rear panel 18, as required.

It is to be understood that the present invention is not limited to the embodiments described above, but encompasses any and all embodiments within the scope of the following claims.

I claim:

1. A portable drier for personal articles, consisting of:

a cabinet including a forward portion and a rearward portion, the forward portion of the cabinet defining an open article drying compartment therein, the rearward portion of the cabinet defining a closed heater compartment therein;

the cabinet having an open front panel, a closed rear panel, a first side panel, a second side panel, and a top panel, the panels defining the forward portion and the rearward portion of the cabinet, the open front panel defining an opening therein, the opening providing convenient access through the open front panel to the open article drying compartment;

a unitary ultraviolet light disposed above the article drying compartment;

a louvered panel disposed between the forward portion and the rearward portion of the cabinet;

an article drying rack disposed in the open article drying compartment;

a closed bottom panel disposed beneath the forward portion and the rearward portion of the cabinet, the bottom panel comprising a water collection tray;

the heater compartment having:

a steam generator disposed upon the bottom panel;

a steam heating pipe array disposed within the heater compartment between the louvered panel and the rear panel, the steam heating pipe array communicating fluidly with the steam generator;

an air filter disposed within the heater compartment between and the rear panel;

an air circulation system disposed upon the bottom panel, the air circulation system being adapted to circulate air through the heater compartment, the louvered panel, and the article drying compartment;

a water tank for providing a supply of water;

wherein the steam heating pipe array communicating fluidly with the steam generator for circulating the steam therethrough and returning water to the water tank; and a scent dispenser communicating with the heater compartment;

wherein the scent dispenser being designed and configured for dispensing scent into air being circulated;

a plurality of wheels disposed beneath the bottom panel, the wheels supporting the cabinet;

wherein the plurality of wheels allow the cabinet to be moved on demand;

an ironing board hingedly disposed upon an exterior of one of the side panels, the ironing board being selectively pivoted between vertically stored and horizontally useable positions; and an iron disposed adjacent to the ironing board.

* * * * *